US011428155B2

(12) United States Patent
Lana et al.

(10) Patent No.: US 11,428,155 B2
(45) Date of Patent: Aug. 30, 2022

(54) TWO POINT FUEL SYSTEM FOR GAS POWER GENERATION

(71) Applicant: Cummins Inc., Columbus, IN (US)

(72) Inventors: Carlos A. Lana, Columbus, IN (US); Trideep Singh, Bhilai (IN); Veronica S. Perks, Greenwood, IN (US); Steven Kolhouse, Columbus, IN (US); Robin J. Bremmer, Columbus, IN (US); Philipe F. Saad, Columbus, IN (US); Agneya Turlapati, Indianapolis, IN (US); Milan Visaria, Pune (IN)

(73) Assignee: CUMMINS INC., Columbus, IN (US)

( * ) Notice: Subject to any disclaimer, the term of this patent is extended or adjusted under 35 U.S.C. 154(b) by 0 days.

(21) Appl. No.: 17/058,520

(22) PCT Filed: Jul. 24, 2019

(86) PCT No.: PCT/US2019/043248
§ 371 (c)(1),
(2) Date: Nov. 24, 2020

(87) PCT Pub. No.: WO2020/023639
PCT Pub. Date: Jan. 30, 2020

(65) Prior Publication Data

US 2021/0215094 A1 Jul. 15, 2021

Related U.S. Application Data

(60) Provisional application No. 62/702,738, filed on Jul. 24, 2018.

(51) Int. Cl.

| | |
|---|---|
| ***F02B 39/10*** | (2006.01) |
| ***F02B 37/10*** | (2006.01) |
| *F02M 21/02* | (2006.01) |

(52) U.S. Cl.
CPC ..... *F02B 39/10* (2013.01); *F02B 37/10* (2013.01); *F02M 21/023* (2013.01); *F02M 21/0215* (2013.01)

(58) Field of Classification Search
CPC ..... F02B 39/10; F02B 37/10; F02B 29/04; F02B 37/04; F02M 21/0215;
(Continued)

(56) References Cited

U.S. PATENT DOCUMENTS

| | | | |
|---|---|---|---|
| 5,549,083 | A | 8/1996 | Feuling |
| 5,775,282 | A | 7/1998 | Smith |

(Continued)

FOREIGN PATENT DOCUMENTS

| | | | |
|---|---|---|---|
| WO | 2010128125 | A1 | 11/2010 |
| WO | 2010128127 | A2 | 11/2010 |

(Continued)

OTHER PUBLICATIONS

International Search Report and Written Opinion issued by the ISA/US, Commissioner for Patents, dated Oct. 22, 2019, for International Application No. PCT/US2019/043248; 8 pages.

*Primary Examiner* — Sizo B Vilakazi
(74) *Attorney, Agent, or Firm* — Faegre, Drinker, Biddle & Reath, LLP

(57) ABSTRACT

The present disclosure provides an engine fueling system that includes multiple fueling valves such that the fuel transport delay can be reduced. The fueling system may also include an electrically driven compressor to improve engine properties during engine startup. For example, an engine fueling system comprising: a first compressor; an intake air throttle operably coupled to the first compressor and positioned downstream of the first compressor; a primary fuel path in communication with a fuel supply, wherein a first fuel from the fuel supply is injected into the primary fuel
(Continued)

path upstream from the compressor; and a secondary fuel path in communication with the fuel supply, wherein a second fuel from the fuel supply is injected into the secondary fuel path downstream from the compressor.

20 Claims, 7 Drawing Sheets

(58) Field of Classification Search
CPC .. F02M 21/023; F02M 21/04; F02M 21/0218; Y02T 10/12; Y02T 10/30
See application file for complete search history.

(56) References Cited

U.S. PATENT DOCUMENTS

| | | | | |
|---|---|---|---|---|
| 6,371,092 | B1 | 4/2002 | Guglielmo et al. | |
| 8,132,560 | B2 | 3/2012 | Ulrey et al. | |
| 8,141,361 | B2 | 3/2012 | Andersen | |
| 8,899,040 | B2 | 12/2014 | Vijayaraghavan et al. | |
| 9,574,490 | B2 | 2/2017 | Watanabe | |
| 9,797,322 | B2 | 10/2017 | Pursifull et al. | |
| 2002/0113439 | A1* | 8/2002 | Thomas | F02P 9/005 290/40 A |
| 2009/0139230 | A1* | 6/2009 | Baldwin | F02B 37/16 60/612 |
| 2012/0279218 | A1* | 11/2012 | Ishida | F01K 23/065 60/611 |
| 2014/0260196 | A1* | 9/2014 | LaPointe | F01N 3/103 60/274 |
| 2014/0261322 | A1 | 9/2014 | Geckler et al. | |
| 2016/0040609 | A1* | 2/2016 | Flohr | F02D 19/0613 123/526 |
| 2017/0130658 | A1* | 5/2017 | Makkapati | F02B 39/10 |

FOREIGN PATENT DOCUMENTS

| | | | |
|---|---|---|---|
| WO | 2012021990 | A1 | 2/2012 |
| WO | 2013039949 | A1 | 3/2013 |
| WO | 2015013241 | A2 | 1/2015 |
| WO | 2015113158 | A1 | 8/2015 |

* cited by examiner

TWO POINT FUEL SYSTEM FOR GAS POWER GENERATION

RELATED APPLICATIONS

This application is a national phase filing of International Application No. PCT/US2019/043248, filed Jul. 24, 2019, which claims the benefit of U.S. Provisional Application Ser. No. 62/702,738, filed on Jul. 24, 2018, and titled "TWO POINT FUEL SYSTEM FOR GAS POWER GENERATION," the complete disclosures of which being expressly incorporated herein by reference.

TECHNICAL FIELD OF THE PRESENT DISCLOSURE

The present invention generally relates to an engine fueling system for an internal combustion engine, and more particularly, to a two point fuel system for gas power generation.

BACKGROUND OF THE PRESENT DISCLOSURE

Natural gas (NG) may be supplied to engines as fuel and comprises several different gases including methane and others, such as, ethane, propane, butane, carbon dioxide, oxygen, hydrogen, and nitrogen. Natural gas also may include water and hydrogen sulfide, and large or unsaturated hydrocarbons, which are hydrocarbons with double or triple covalent bonds between adjacent carbon atoms.

For internal combustion engines, engine startup time can have strict requirements with respect to critical applications for power generation. Typical NG engine configurations incorporate fuel upstream of the compressor which permits operation with low pressure NG systems. However, this configuration introduces a delay in fuel delivery from the fueling point to the cylinders known as the "fuel transport delay." This, in turn, extends cranking time and consequently, delays the engine startup by several seconds. Improvements in the foregoing are desired.

SUMMARY OF THE PRESENT DISCLOSURE

The present disclosure provides an engine fueling system that includes multiple fueling valves such that the fuel transport delay can be reduced. The fueling system may also include an electrically driven compressor to improve engine properties during engine startup.

In an illustrative embodiment of the present disclosure, an engine fueling system is disclosed. The engine fueling system comprises: a first compressor; an intake air throttle operably coupled to the first compressor and positioned downstream of the first compressor; a primary fuel path in communication with a fuel supply, wherein a first fuel from the fuel supply is injected into the primary fuel path upstream from the compressor; and a secondary fuel path in communication with the fuel supply, wherein a second fuel from the fuel supply is injected into the secondary fuel path downstream from the compressor.

The engine fueling system may further comprise a charge air cooler positioned downstream of the first compressor and operably coupled to the first compressor and the intake air throttle. Where the engine fueling system comprises a charge air cooler, the second fuel from the secondary fuel path may be injected upstream from the intake air throttle and the charge air cooler; alternately, the second fuel from the secondary fuel path may be injected downstream from the intake air throttle and upstream of the charge air cooler. The engine fueling system may further comprise a mixer operably coupled to the first compressor and the intake air throttle, wherein the first fuel from the primary fuel path and the second fuel from the secondary fuel path may mix to form a mixed fuel.

The engine fueling system may further comprise a second compressor positioned downstream from the intake air throttle. Where the engine fueling system comprises a second compressor, the second compressor may be configured to increase engine speed rate time during engine startup and decrease load ramp rate. Operating settings of the second compressor may be configured to adjust in real time according to the requirements of the engine. The engine fueling system may further comprise an air filter positioned upstream of the first compressor, wherein the first fuel from the primary fuel path is injected downstream from the air filter and upstream of the first compressor. The second fuel from the secondary fuel path may have a pressure of at least 0.5 bar absolute.

In another illustrative embodiment of the present disclosure, a method of fueling an internal combustion engine is disclosed. The method comprises the steps of: providing an engine fueling system, comprising: a plurality of combustion cylinders; a first compressor upstream from the plurality of combustion cylinders, a primary fuel path in communication with a fuel supply and in selective communication with the plurality of combustion cylinders via a first valve; and a secondary fuel path in communication with the fuel supply and in selective communication with the plurality of combustion cylinders via a second valve; injecting a first fuel from the fuel supply into the primary fuel path upstream from the first compressor; injecting a second fuel from the fuel supply into the secondary fuel path downstream from the first compressor; selectively fueling the plurality of combustion cylinders by the primary fuel path, the secondary fuel path, or both the primary fuel path and the secondary fuel path; and delivering at least the first fuel or at least the second fuel into the plurality of combustion cylinders via injection or fumigation.

The method of fueling an internal combustion engine may further comprise the step of mixing the first fuel from the primary path and the second fuel from the secondary path to form a mixed fuel. Where a mixed fuel is formed, the method may further comprise the step of injecting the mixed fuel into an intake manifold operably coupled to the plurality of combustion cylinders. Where a mixed fuel is formed, the method may further comprise the step of injecting the mixed fuel directly into each of the plurality of combustion cylinders via a plurality of individual injector ports, each of the plurality of individual injector ports coupled to one of the plurality of combustion cylinders.

The engine fueling system of the method may further comprise an air intake throttle and a charge air cooler, wherein the charge air cooler is positioned upstream from the plurality of combustion cylinders and downstream of the first compressor. Where the system includes the air intake throttle, the air intake throttle may be positioned upstream from the plurality of combustion cylinders and downstream of the first compressor. The second fuel from the secondary fuel path may be injected upstream from the intake air throttle, the charge air cooler, and the plurality of combustion cylinders; alternately, the second fuel from the secondary fuel path may be injected downstream from the intake air throttle and upstream of the charge air cooler and the plurality of combustion cylinders. The engine fueling system may further comprise a second compressor positioned downstream from the intake air throttle. Where the engine fueling system includes a second compressor, the method may further comprise the step of increasing engine speed rate time during engine startup via the second compressor. Where the engine fueling system includes a second compressor, the method may further comprise the step of decreasing load ramp rate via the second compressor. Where the engine fueling system includes a second compressor, the method may further comprise the step of adjusting operating settings of the second compressor in real time according to the requirements of the engine.

Where the fueling system includes an air intake throttle, the air intake throttle may be positioned upstream from the plurality of combustion cylinders and the first compressor. The first compressor may be an electrically powered turbocharger and may be a hybrid turbocharger. The method may comprise the step of adjusting the operating settings of the first compressor in real time according to requirements of the engine.

The engine fueling system of the method may comprise an air filter positioned upstream of the first compressor. Where the engine fueling system includes an air filter, the first fuel from the primary fuel path may be injected downstream from the air filter and upstream of the first compressor. The first fuel from the first primary fuel path and the second fuel from the secondary fuel path may be injected simultaneously. The second fuel from the secondary fuel path may have a pressure of at least 0.5 bar absolute.

In yet another illustrative embodiment of the present disclosure, an engine fueling system for an internal combustion engine is disclosed. The engine fueling system comprises: a plurality of combustion cylinders; and a mixer, a compressor, a charge air cooler, and an intake air throttle upstream from the plurality of combustion chambers; wherein the mixer, the compressor, the charge air cooler, and the intake air throttle are operably coupled to each other; wherein the compressor is an electrically powered turbocharger positioned upstream from the plurality of combustion cylinders and downstream of the intake air throttle; and wherein the electrically powered turbocharger is configured to increase engine speed ramp up during engine startup. The electrically powered turbocharger may be a hybrid turbocharger. Operating settings of the compressor may be configured to adjust in real time according to the requirements of the engine.

In yet another illustrative embodiment of the present disclosure, an engine fueling system is disclosed. The engine fueling system comprises: a plurality of combustion cylinders; a compressor upstream from the plurality of combustion cylinders; a primary fuel path in communication with a fuel supply and in selective communication with the plurality of combustion cylinders via a first valve, wherein a first fuel from the fuel supply is injected into the primary fuel path upstream from the compressor; and a secondary fuel path in communication with the fuel supply and in selective communication with the plurality of combustion cylinders via a second valve, wherein a second fuel from the fuel supply is injected into the secondary fuel path downstream from the compressor; wherein the plurality of combustion cylinders is selectively fueled by the primary fuel path, the secondary fuel path, or both; and wherein at least the first fuel or the second fuel is driven into the plurality of combustion cylinders via injection or fumigation.

The first fuel from the primary fuel path and the second fuel from the secondary fuel path may mix to form a mixed fuel. In such an embodiment, the mixed fuel may be injected into an intake manifold operably coupled to the plurality of combustion cylinders. In an embodiment with mixed fuel, the mixed fuel may by injected directly into each of the plurality of combustion cylinders via a plurality of individual injector ports, wherein each of the plurality of individual injector ports may be coupled to one of the plurality of combustion cylinders. The engine fueling system may further comprise an air intake throttle and a charge air cooler, wherein the air intake throttle and the charge air cooler are positioned upstream from the plurality of combustion cylinders and downstream of the compressor. Where the engine fueling system includes an air intake throttle and a charge air cooler, the second fuel from the secondary fuel path may be injected upstream from the intake air throttle, the charge air cooler, and the plurality of combustion cylinders; alternately, the second fuel from the secondary fuel path is injected downstream from the intake air throttle and upstream of the charge air cooler and the plurality of combustion cylinders.

The engine fueling system may further comprise an air filter positioned upstream the compressor, wherein the first fuel from the primary fuel path is injected downstream from the air filter and upstream of the compressor. The first valve and the second valve may be operated simultaneously. The second fuel from the secondary fuel path may have a pressure of at least 0.5 bar absolute.

DETAILED DESCRIPTION OF THE DRAWINGS

The present disclosure provides an engine fueling system that includes multiple fueling valves such that the fuel transport delay can be reduced. The fueling system may also include an electrically driven compressor to improve engine properties during engine startup.

Figure 1:
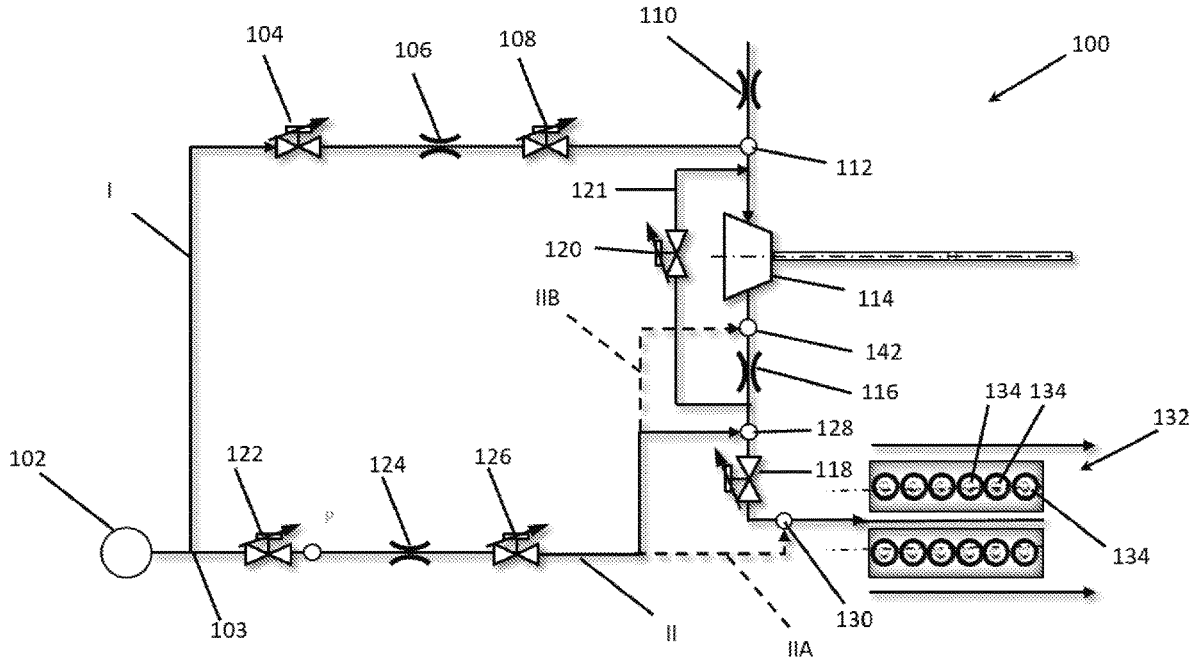
FIG. 1 is a block diagram illustrating an embodiment of an engine fueling system including a primary fuel path and a secondary fuel path set forth in the present disclosure.

Referring first to FIG. 1, an engine fueling system 100 is shown in which fuel or gas (e.g., natural gas including methane) is provided to an internal combustion engine 132. Engine fueling system 100 may be an on-board assembly directly supported on engine 132. In one embodiment, engine fueling system 100 is an on-board assembly provided separately, and spaced apart, from engine 132. In particular, engine fueling system 100 may be positioned in proximity to engine 132 but is not supported directly on engine 132 or contained within the engine housing. For example, in one embodiment, engine 132 may be provided in a stationary generator supported on a concrete pad and engine fueling system 100 also may be supported on the concrete pad in proximity to engine 132. As such, the size of engine fueling system 100 may be reduced to correspond to the unoccupied area of the platform or location supporting engine 132. Therefore, engine 132 and engine fueling system 100 may be positioned adjacent each other or in a defined proximity to each other.

Engine 132 includes at least one combustion chamber 134 and an intake manifold 136 (as shown in at least FIGS. 2-5). Engine 132 can have combustion chambers 134 in an inline or V-configuration. Moreover, depending on the configuration, engine 132 can comprise a center intake manifold and/or a center exhaust manifold. During operation of engine 132, fuel can be injected or mixed with air anywhere downstream of a primary fuel point via fumigation, which mixes in the engine cylinder. Combustion exhaust gases from the injection processes are released via exhaust manifold 140 (at least FIGS. 2-5) from combustion chambers 134 before a subsequent combustion process is initiated. As disclosed herein, engine 132 may operate entirely on methane gas. Alternatively, engine 132 may comprise a dual-fuel internal combustion engine that operates, at different times, on one of at least two fuels, or a combination of these fuels. Example fuels include methane gas, diesel, dimethyl ether, gasoline, and other fuels that contain nitrogen, carbon dioxide ($CO_2$), and oxygen ($O_2$).

As shown in FIG. 1, engine fueling system 100 is operably coupled to engine 132 and includes a fuel or gas supply 102, an air filter 110, a compressor (e.g., turbocharger) 114, a charge air cooler 116, and an intake air throttle 118. Compressor 114 may include a supercharger/electrical compressor in combination with a turbocharger. Compressor 114 may also include an electrically driven compressor or an electrically assisted compressor. Engine fueling system 100 further includes a compressor bypass valve 120 and a compressor bypass line 121 that circumvents compressor 114 and charge air cooler 116. As shown in FIG. 1, engine fueling system 100 receives fuel from a fuel supply 102. Fuel supply 102 may be an underground gas reservoir, a gas tank, or other storage-type container or location for gas. When in fuel supply 102, the fuel may be compressed. As noted above, in some embodiments, engine 132 may comprise a dual-fuel internal combustion engine that operates on a combination of fuels. In such an embodiment, multiple fuel supplies may be present to provide fuel separately or combined to a primary fuel path I and a secondary fuel path II, discussed herein.

Fuel (e.g., gas) flows from fuel supply 102 to engine 132. More particularly, as shown in FIG. 1, fuel flows from fuel source 102 to junction 103 where the fuel splits into a primary fuel path I and a secondary fuel path II. The amount of fuel that flows through primary fuel path I and second fuel path II is controlled by fuel shut off valves 104, 122 and fuel metering devices 106, 124. For example, fuel may be supplied from only the primary fuel path I, from only the secondary fuel path II, or from any mixture of fuel from both primary fuel path I and primary fuel path II. In one embodiment, these devices are coupled to an electronic control module (ECM) (not shown) which controls the state of the valves 104, 122 based on the metering devices 106, 124. Primary and secondary fuel paths I, II also include a primary fuel valve or injector 108 and a secondary fuel valve or injector 126, respectively. Like shutoff valves 104, 122 and fuel metering devices 106, 124, fuel injectors 108, 126 are operably coupled to an ECM (not shown) to control the amount of fuel injected from each fuel path.

Primary fuel path I is configured to inject fuel upstream from compressor 114 at mixer 112 as shown in at least FIGS. 1-5. At mixer 112, air that passes through air filter 110 mixes with fuel from fuel supply 102. From mixer 112, the air and primary fuel mixture flows through compressor 114. After flowing through compressor 114, the air and primary fuel mixture mixes with fuel from secondary fuel path II at a mixer, flows through charge air cooler 116, and flows through intake air throttle 118 where the mixer, charge air cooler 116, and intake air throttle 118 are in various configurations as described further herein.

Figure 3:
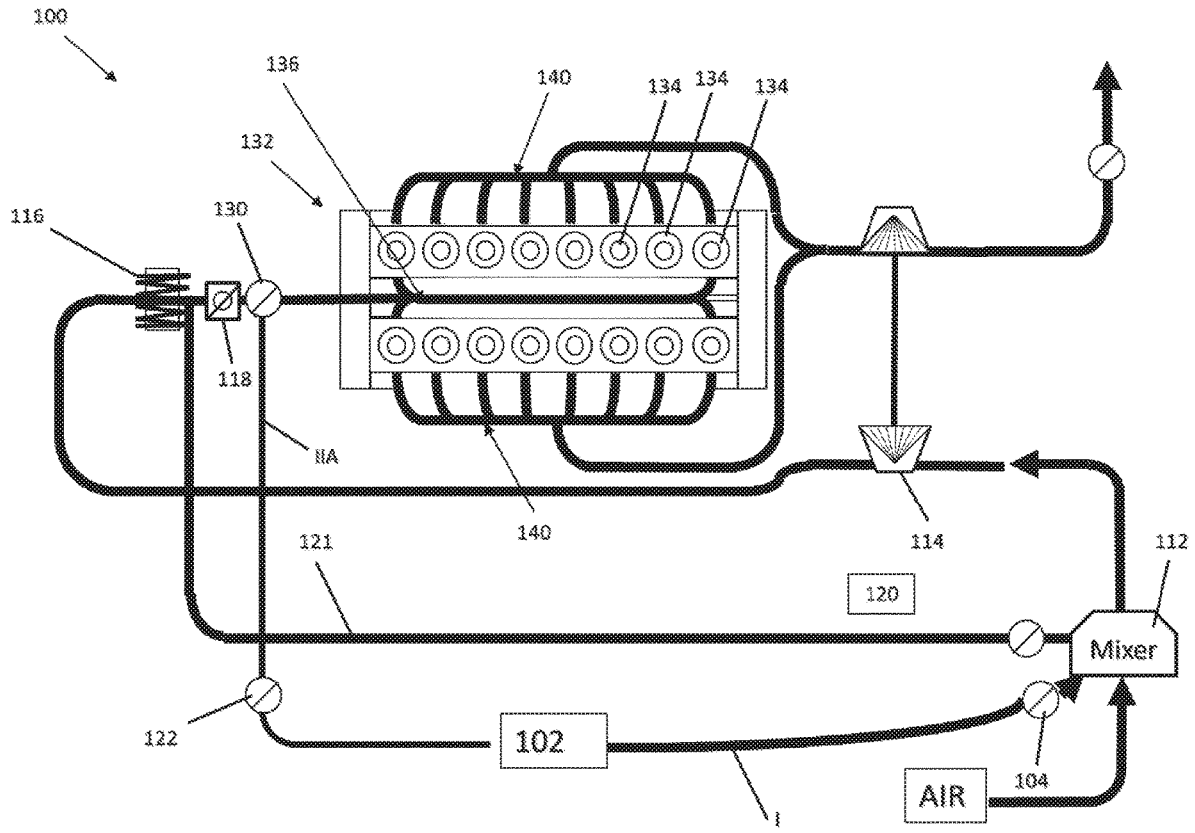
FIG. 3 is a diagram illustrating an alternative embodiment of the engine fueling system of FIG. 1 in relation to the secondary fuel path.
Figure 4:
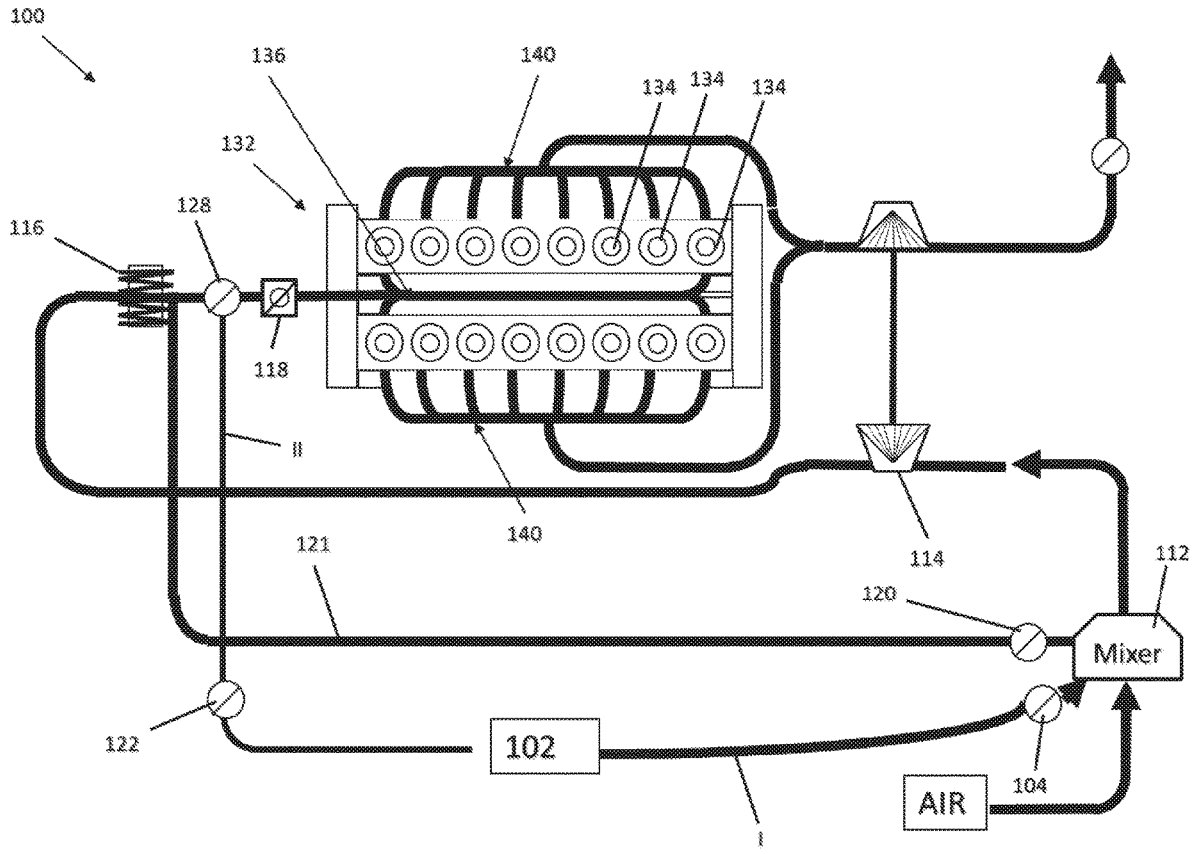
FIG. 4 is a diagram illustrating an embodiment of the engine fueling system of FIG. 1 in relation to the secondary fuel path.
Figure 5:
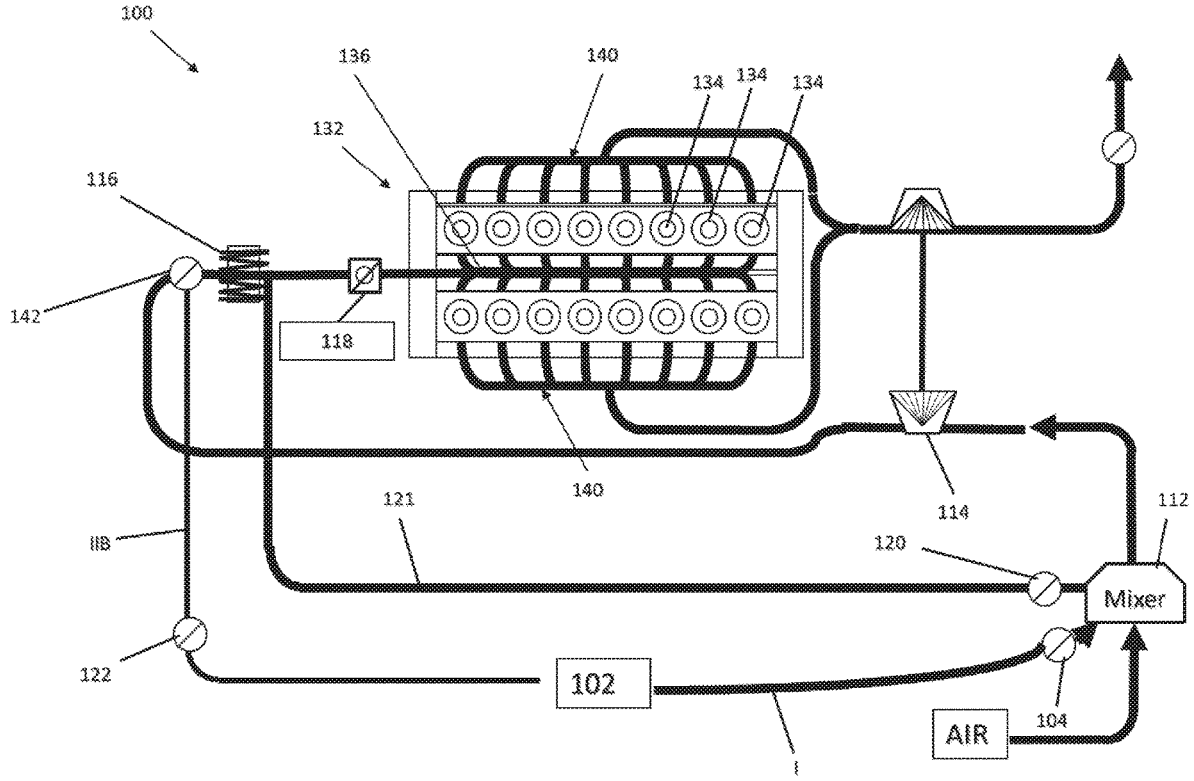
FIG. 5 is a diagram illustrating an embodiment of the engine fueling system of FIG. 1 in relation to the secondary fuel path.

Secondary fuel path II is configured to inject fuel downstream from compressor 114. As shown in FIGS. 1 and 4, secondary fuel path II is injected into mixer 128 which is downstream of compressor 114 and charge air cooler 116 but upstream intake air throttle 118. Alternatively, as shown in FIGS. 1 and 3, secondary fuel path can follow secondary fuel path IIA where fuel from secondary fuel path IIA is injected into mixer 130, which is downstream of compressor 114, charge air cooler 116, and intake air throttle 118. Also, as shown in FIGS. 1 and 5, secondary fuel path can follow secondary fuel path IIB where fuel from secondary fuel path IIB is injected into mixer 142, which is downstream of compressor 114 and upstream of charge air cooler 116 and intake air throttle 118. Furthermore, as shown in FIG. 2 and discussed further herein, secondary fuel path can follow secondary fuel path IIC where fuel from secondary fuel path IIC is mixed with the air and primary fuel mixture when the air and primary fuel mixture reaches the secondary fueling location and can be injected directly into cylinders 134 via individual injectors 138 that are each coupled to a single cylinder 134 or via fumigation where the charge mixture is driven by the air flow into the cylinders.

The configuration of fueling system 100 enables engine startup times of engine 132 to be greatly reduced. That is, engine speed ramp up of engine 132 to a transient state is improved. During startup of engine 132, the ECM (not shown) simultaneously opens fuel injectors or valves 108, 126 to allow fuel from primary fuel path I and secondary fuel path II to flow. Once valves 108, 126 are opened, fuel flowing through secondary fuel path II flows through mixer 128 and intake air throttle 118 and into cylinders 134 to enable engine 132 to start. During this time, when valve 108 is opened during engine startup, fuel flowing through primary fuel path I flows into mixer 112 where the fuel is mixed with air passing through air filter 110. The air fuel mixture then proceeds to compressor 114 or in some cases, through compressor bypass valve line 121 and compressor bypass valve 120. Then, the air fuel mixture flows through charge air cooler 116 and into mixer 128. At mixer 128, the air fuel mixture is mixed with fuel from secondary flow path II.

Mixer 128 is operably coupled to an ECM such that the desired air to fuel ratio can be sent to cylinders 134. When the air fuel mixture mixes with fuel from the secondary fuel path, a mixed fuel is formed and the air fuel ratio of the mixed fuel is measured via sensors (not shown) and compared to a predetermined air fuel ratio threshold stored in the ECM. Based on the comparison with the threshold, the ECM (not shown) can adjust the amount of fuel received from secondary fuel path II to maintain the desired air fuel ratio within engine fueling system 100. In an alternate embodiment, secondary fuel path IIA is employed with mixer 130 to function in the manner described above. In another alternate embodiment, secondary fuel path IIB is employed with mixer 142 to function in the manner described above.

Figure 2:
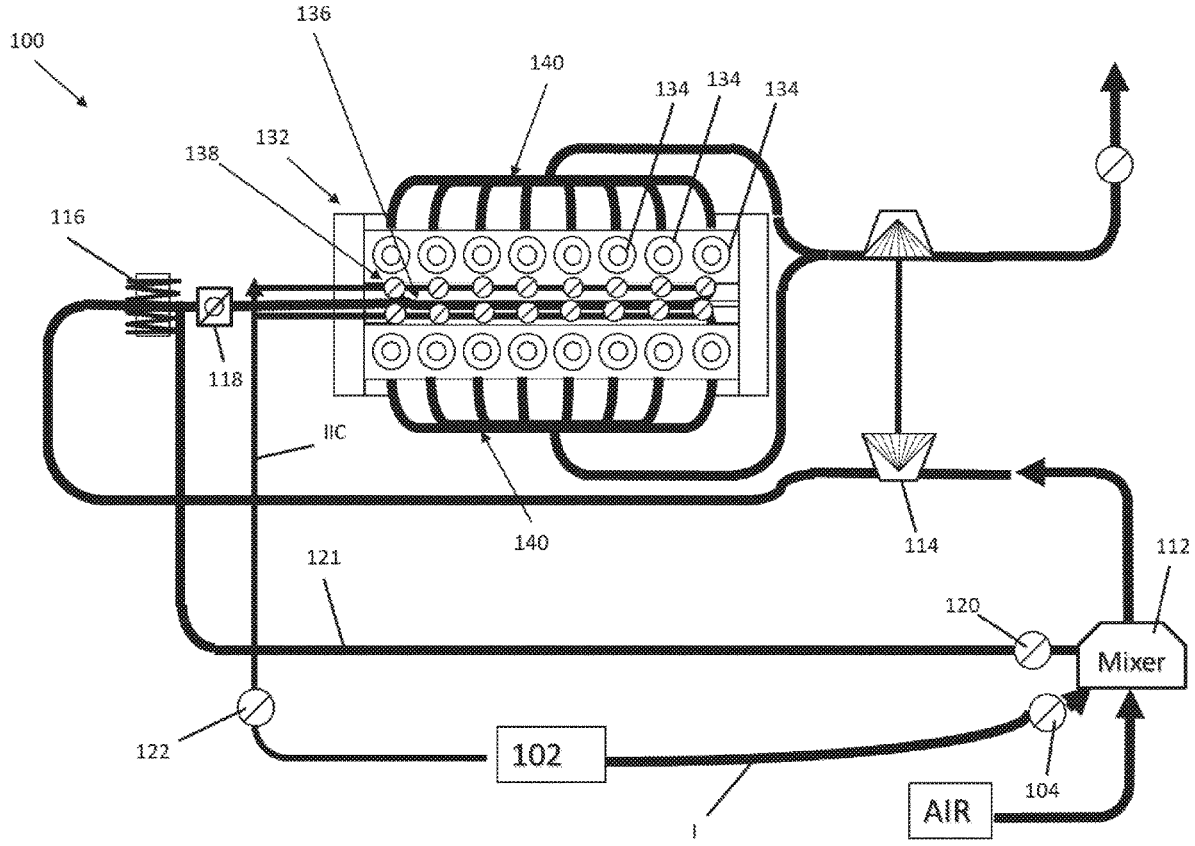
FIG. 2 is a diagram illustrating an alternative embodiment of the engine fueling system of FIG. 1 in relation to the secondary fuel path.

In a further embodiment, as shown in FIG. 2, secondary fuel path IIC is employed. As shown in FIG. 2, a mixer is not provided to mix the fuel from primary fuel path I and secondary fuel paths II, IIA, or IIB as described above. Rather, engine 132 provides individual port injectors and valves 138 that are coupled to each combustion cylinder 134 within intake manifold 136. In this configuration, fuel from secondary fuel path IIC and the air fuel mixture from primary fuel path I separately flow into intake manifold 136. Once in intake manifold 136, fuel from secondary fuel path IIC and the air fuel mixture are fed into individual port injectors or valves 138 whereupon fuel from secondary fuel path IIC and the air fuel mixture are mixed to form a mixed fuel. The mixed fuel can then be injected into cylinder 134 or can be passed into cylinder 134 via fumigation. Similar to mixers 128, 130, and 142, fuel injectors 138 are coupled to an ECM (not shown) such that a desired air fuel ratio within engine 132 is maintained.

Advantageously, the configuration of fuel system 100 provides for a reduced engine startup time during cranking. That is, secondary fuel paths II, IIA, IIB, or IIC function to reduce the fuel transport delay, which reduces the engine startup time during cranking. For example, the present configuration provides for engine 132 to transition from 0 revolutions per minute (rpm) to 18000 rpm in 10 seconds. Additionally, a high pressure fuel source or a high pressure fuel system is not required in engine fueling system 100 due to the presence of a secondary fuel path. Pressures of the secondary fuel path II, IIA, IIB, or IIC can be at least 0.5 bar absolute because the intake throttle can be partially closed and create the necessary pressure differential to drive fuel into the intake manifold. Moreover, because the fuel supply used can be low pressure, engine fueling system 100 is of a low cost architecture as compared to port fueling or high pressure architectures, which require additional units such as a high flow injector pump.

Figure 6:
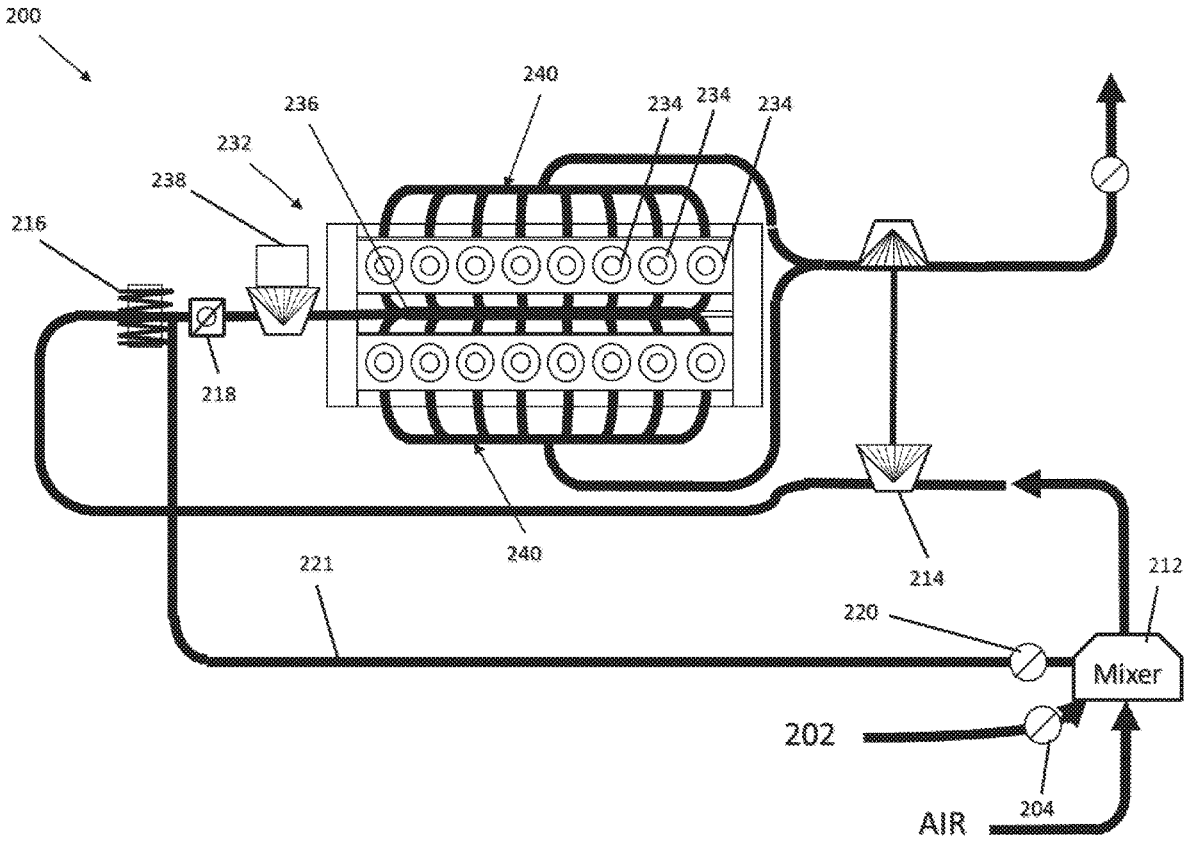
FIG. 6 is a block diagram illustrating an alternative embodiment of an engine fueling system that includes an electric compressor as set forth in the disclosure.
Figure 7:
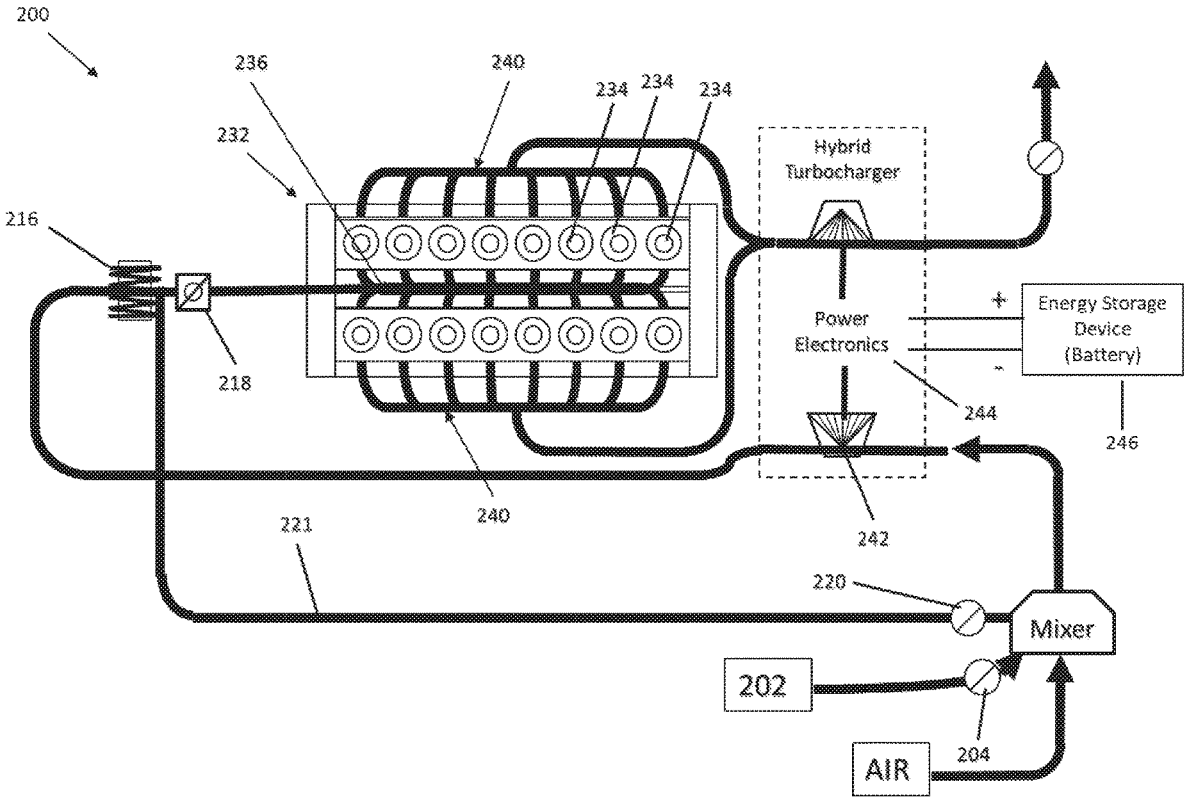
FIG. 7 is a block diagram illustrating a further alternative embodiment of an engine fueling system as set forth in the disclosure.

Referring now FIGS. 6 and 7, an engine fueling system 200 is shown in conjunction with an engine 232 having cylinders 234. As shown, fuel from fuel supply 202 is fed into mixer 212 via fuel control 204. Air is also provided to mixer 212 through an air filter (not shown) analogous to air filter 110 shown in FIGS. 1-5. At mixer 212, fuel and air mix to form an air fuel mixture. As shown in FIG. 6, the air fuel mixture from mixer 212 proceeds through compressor 214 (e.g., turbocharger), charge air cooler 216, and throttle 218 similar to the embodiments described above and shown in FIGS. 1-5. Also, a compressor bypass line 221 having a compressor bypass valve 220 is provided from mixer 212 where the compressor bypass line 221 leads the air fuel mixture to throttle 218.

Downstream from throttle 218 and upstream from engine 232 is an electrically powered compressor 238. Electrically powered compressor 238 functions to assist engine 232 during engine startup and transient operation of a vehicle. During an engine start, compressor 238 boosts engine 232 from the starting speed of the vehicle to an idling state of the vehicle to provide a fast speed ramp up from 0 revolutions per minute (rpm) to an idling speed. Stated another way, compressor 238 assists engine 232 in reducing the engine speed ramp up (i.e., it will take a shorter time for the engine to ramp up from 0 rpm to 1800 rpm, for example) and the load ramp up time (e.g., from 0% to 100% load) by expediting the availability of high density air/fuel mixture (i.e., compressed mixture) in the intake manifold, which translates into high engine torque.

Furthermore, electrical compressor 238 enhances genset performance during load pickup by providing a fast engine boost build as compared to a conventional turbocharger. Moreover, the engine boost provided by electrical compressor 238 enables synchronization with an ECM (not shown) to provide dynamic real time adjustment of electrically powered compressor 238 depending on the requirements of engine 232.

In another embodiment, as shown in FIG. 7, a similar engine fueling system 200 is provided where similar reference numbers indicate similar parts having similar functions. However, a compressor 242 is provided downstream mixer 212. Compressor 242 is a hybrid tuborcharger that is powered by an energy storage device 246 (e.g., battery). In another embodiment, compressor 242 is an electrically assisted compressor. Compressor 242 further includes power electronics 244 electrically coupled to energy storage device 246. Power electronics 244 provide dynamic functionality of compressor 242 such that the operating settings of compressor 242 can be adjusted in real-time depending on the needs of engine 232.

While the invention has been described by reference to various specific embodiments it should be understood that numerous changes may be made within the spirit and scope of the inventive concepts described, accordingly, it is intended that the invention not be limited to the described embodiments but will have full scope defined by the language of the following claims.

What is claimed is:

1. An engine fueling system comprising:

a first compressor;

an intake air throttle operably coupled to the first compressor and positioned downstream of the first compressor;

a primary fuel path in communication with a fuel supply, wherein a first fuel from the fuel supply is injected into the primary fuel path upstream from the compressor; and a secondary fuel path in communication with the fuel supply, wherein a second fuel from the fuel supply is injected into the secondary fuel path downstream from the compressor.

2. The engine fueling system of claim 1, further comprising a charge air cooler positioned downstream of the first compressor and operably coupled to the first compressor and the intake air throttle.

3. The engine fueling system of claim 1, further comprising a mixer operably coupled to the first compressor and the intake air throttle.

4. The engine fueling system of claim 1, further comprising a second compressor positioned downstream from the intake air throttle.

5. The engine fueling system of claim 1, further comprising an air filter positioned upstream of the first compressor.

6. The engine fueling system of claim 1, wherein the second fuel from the secondary fuel path has a pressure of at least 0.5 bar absolute.

7. A method fueling an internal combustion engine, the method comprising the steps of:

providing an engine fueling system, comprising:

a plurality of combustion cylinders;

a primary fuel path in communication with a fuel supply and in selective communication with the plurality of combustion cylinders via a first valve; and a secondary fuel path in communication with the fuel supply and in selective communication with the plurality of combustion cylinders via a second valve;

injecting a first fuel from the fuel supply;

injecting a first fuel from the fuel supply into the primary fuel path upstream from the first compressor;

injecting a second fuel from the fuel supply into the secondary fuel path downstream from the first compressor;

selectively fueling the plurality of combustion cylinders by the primary fuel path, the secondary fuel path, or both the primary fuel path and the secondary fuel path; and delivering at least the first fuel or at least the second fuel into the plurality of combustion cylinders via injection or fumigation.

8. The method of claim 7, further comprising the step of mixing the first fuel from the primary fuel path and the second fuel from the secondary fuel path to form a mixed fuel.

9. The method of claim 8, further comprising the step of injecting the mixed fuel into an intake manifold operably coupled to the plurality of combustion cylinders.

10. The method of claim 8, further comprising the step of injecting the mixed fuel directly into each of the plurality of combustion cylinders via a plurality of individual injector ports, each of the plurality of individual injector ports coupled to one of the plurality of combustion cylinders.

11. The method of claim 7, wherein the engine fueling system further comprises an air intake throttle and a charge air cooler, wherein the charge air cooler and is positioned upstream from the plurality of combustion cylinders and downstream of the first compressor.

12. The method of claim 11, wherein the air intake throttle is positioned upstream from the plurality of combustion cylinders and downstream of the first compressor.

13. The method of claim 12, wherein the second fuel from the secondary fuel path is injected upstream from the intake air throttle, the charge air cooler, and a plurality of combustion cylinders.

14. The method of claim 12, wherein the second fuel from the secondary fuel path is injected downstream from the intake air throttle and upstream of the charge air cooler and the plurality of combustion cylinders.

15. The method of claim 12, wherein the engine fueling system further comprises a second compressor positioned downstream from the intake air throttle.

16. The method of claim 15, the method further comprising the step of increasing engine speed rate time during engine startup and decreasing load ramp rate via the second compressor.

17. The method of claim 11, wherein the air intake throttle is positioned upstream from the plurality of combustion cylinders and the first compressor.

18. The method of claim 17, wherein the first compressor is an electrically powered hybrid turbocharger.

19. The method of claim 11, wherein the engine fueling system further comprises an air filter positioned upstream of the first compressor and the first fuel from the primary fuel path is injected downstream from the air filter and upstream of the first compressor.

20. The method of claim 11, wherein the first fuel from the first primary fuel path and the second fuel from the secondary fuel path are injected simultaneously.

* * * * *